United States Patent [19]

Park

[11] Patent Number: 4,481,744

[45] Date of Patent: Nov. 13, 1984

[54] BUILDING STRUCTURE

[75] Inventor: Owen H. Park, Carmel, Ind.

[73] Assignee: Heartland Industries, Inc., Carmel, Ind.

[21] Appl. No.: 354,511

[22] Filed: Mar. 3, 1982

[51] Int. Cl.[3] ..... E04D 11/02

[52] U.S. Cl. ..... 52/92; 52/94

[58] Field of Search ..... 52/90, 92, 93, 94, 86, 52/11, 24, 96, 73

[56] References Cited

U.S. PATENT DOCUMENTS

| | | | |
|---|---|---|---|
| 1,175,734 | 3/1916 | Ewing | 52/92 |
| 1,932,555 | 10/1933 | McKee | 52/90 |
| 2,261,640 | 11/1941 | Bishop | 52/90 |

FOREIGN PATENT DOCUMENTS

| | | | |
|---|---|---|---|
| 660032 | 7/1929 | France | 52/90 |
| 910677 | 6/1946 | France | 52/90 |
| 0001797 | of 1907 | United Kingdom | 52/94 |

*Primary Examiner*—John E. Murtagh

*Attorney, Agent, or Firm*—Barnes & Thornburg

[57] ABSTRACT

In a building which includes outer walls, a roof having a lower border that overhangs one or more of the outer walls, and a frame for supporting the outer walls and roof. The structure embodying the present invention includes a frame member forming an upper portion of the outer wall beneath the overhanging roof border and a wall panel forming a lower portion of the outer wall. The frame member has a top edge adjacent the roof. A roof support member is mounted on the top edge of the frame member at an acute angle to the outer wall to provide the lower border of the roof. The frame member also has a bottom edge which includes a rabbet for receiving the wall panel.

9 Claims, 5 Drawing Figures

BUILDING STRUCTURE

The present invention relates to building structures, and more particularly to improvements which strengthen and straighten the framework, reduce waste of building materials, and provide design flexibility.

Three problems typically associated with building construction are efficient utilization of building materials to reduce waste, efficient utilization of structure to provide maximum strength using minimum structure, and designing structure which facilitates its replacement. Efficient utilization of building materials and structure reduces the overall cost of the building. Buildings having structure which facilitates replacement of various components are more attractive to the potential buyer. Various structural improvements in buildings have heretofore been proposed for solving one or more of the aforementioned problems. However, most structural improvements do not address all three of these problems.

It is one object of the present invention to provide a building structure which reduces building material waste, strengthens and straightens the structure of the building, and facilitates removal and replacement of a component of the building.

Another object of the present invention is to provide a building structure which increases design flexibility and provides decorative features to the building.

These and other objects are achieved in a building which includes outer walls, a roof having a lower border that overhangs one or more of the outer walls, and a frame for supporting the outer walls and roof. The structure embodying the present invention includes a frame member forming an upper portion of the outer wall beneath the overhanging roof border and a wall panel forming a lower portion of the outer wall. The frame member has a top edge adjacent the roof. A roof support member is mounted on the top edge of the frame member at an acute angle to the outer wall to provide the lower border of the roof. The frame member also has a bottom edge which includes a rabbet for receiving the wall panel. In the preferred embodiment, the frame member has a width sufficient to allow construction of a building having an outer wall that is 4 feet high utilizing a wall panel that is 3½ feet high and a building having an outer wall that is 5 feet high utilizing a wall panel that is 4½ feet high. Thus, a sheet of building material that is 8 feet in length can be cut to provide wall panels for both buildings without any waste.

In the preferred embodiment, the frame member is secured transverse to frame studs of the building structure, thereby to increase the strength of the building structure and increase the stiffness of the frame studs.

In one embodiment, the top edge of the frame member is cut to form a top edge surface at an acute angle with respect to an inner surface of the frame member. Cutting the top edge of the frame member in this manner produces a wedge-shaped member which may be secured to an outer surface of the frame member adjacent the roof support member as a decorative finishing piece.

Various features and advantages of the present invention will become apparent in view of the following detailed description of one embodiment thereof exemplifying the best mode of carrying out the invention as presently perceived, which embodiment should be considered in conjunction with the accompanying drawings, in which.

Figure 1:
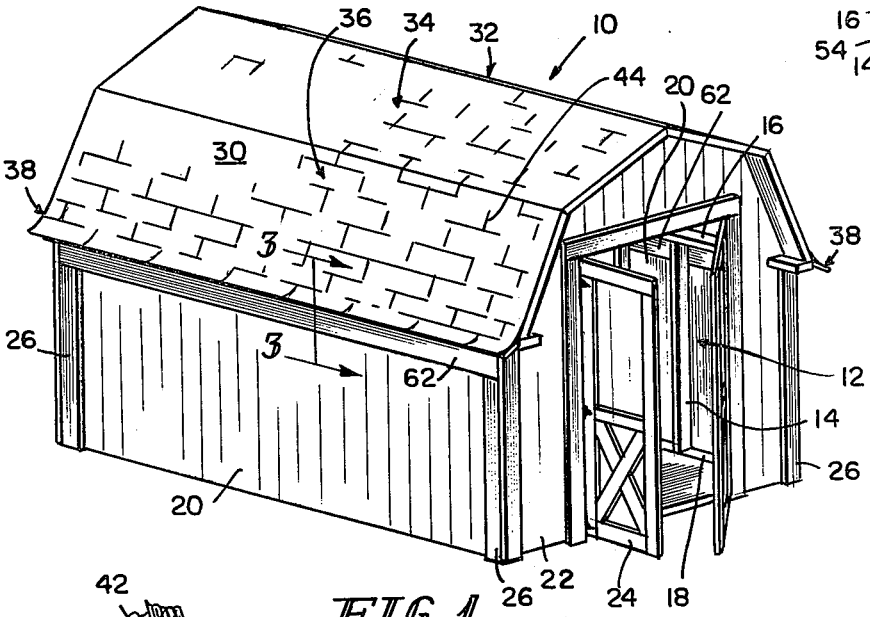
FIG. 1 is a perspective view of a building structure embodying the present invention.

Referring now to FIG. 1, a building structure 10 embodying the present invention comprises a frame 12 which includes a plurality of vertical studs 14 and horizontal top and bottom plates 16 and 18, respectively, supporting the studs 14 in spaced-apart vertical relationship. Outer side wall panels 20 and outer end wall panels 22 are secured to the frame 12 using nails or other conventional means, and a roof 30 is mounted on the frame 12 to enclose the structure. A door 24 is provided in one of the end wall panels 22, allowing access to the interior of the enclosed structure 10. Face boards 26 may be used at the corners of the structure to conceal the ends of the wall panels 20 and 22. Generally speaking, the above-described structural members of building 10 are constructed of wood. However, other materials could be used without departing from the scope of the present invention.

Figure 2:
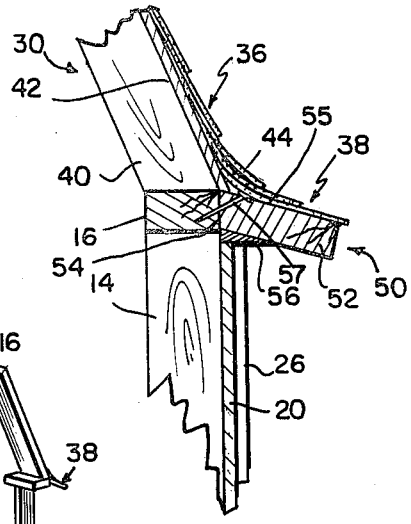
(PRIOR ART) FIG. 2
FIG. 2 is a fragmentary cross-sectional view of a building structure embodying the prior art.
Figure 3:
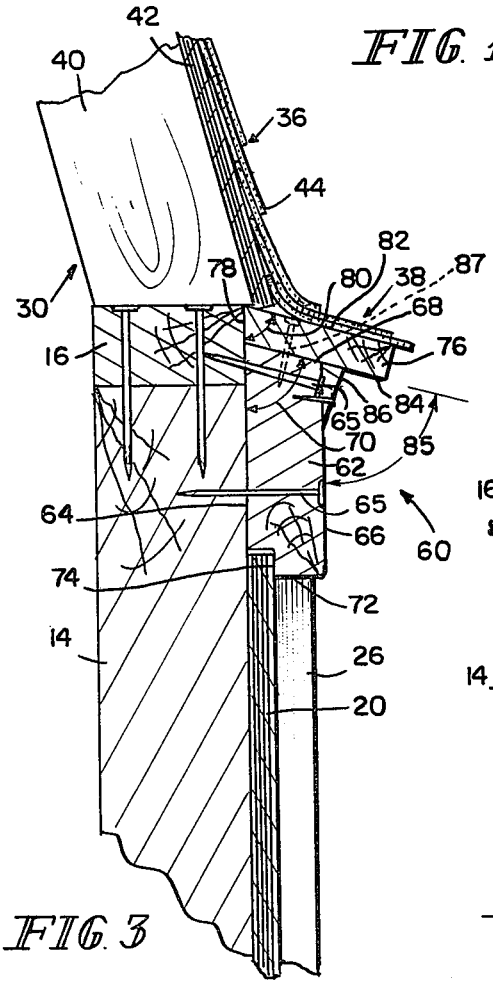
FIG. 3 is a fragmentary cross-sectional view of the building structure shown in FIG. 1, taken generally along section lines 3—3 in FIG. 1.

In the illustrative embodiment of building structure 10, the roof 30 is a curb roof having a double slope on each of its two sides. The roof 30 includes a center ridge 32, an upper section 34 having a first slope, and a lower section 36 having a second slope. In comparison, the upper section 34 has a flatter slope, and the lower section 36 has a steeper slope. As is generally the case with most roofs, roof 30 has a lower border 38 which overhangs the side wall panels 20 on the two sides of the building structure 10. This overhang is sometimes referred to as the eave of the building structure 10. The lower border 38 has a gradual slope in comparison to the slopes of the upper and lower sections 34 and 36. The roof structure includes rafters 40, decking 42 secured to the rafters 40, and shingles 44 covering the decking 42, as best shown in FIGS. 2 and 3. In the building structure 10 shown in FIG. 1, the rafters 40 may include a plurality of 2-inch by 4-inch wooden beams, and the decking may have a thickness of ½ inch. The building and type of roof are not important to the present invention since certain structural elements are common to almost all buildings, such as, for example, frame 12, walls 20 and 22, and a lower roof border 38 which overhangs side walls 20. The present invention is directed to strutural features which may be adapted to various buildings having these structural elements. Thus, it is not intended that the present invention be limited to any specific building or type of roof.

Referring to FIG. 2, the conventional means 50 for providing the overhanging lower border 38 of the roof 30 in the illustrative building structure 10 includes an elongated board 52 having dimensions such as, for example, approximately 2 inches thick and 6 inches wide. The inner edge 54 of the board 52 is cut longitudinally at an acute angle relative to the top 6-inch wide surface 55. The wedge-shaped member 56 cut from the inner edge 54 is positioned between the side wall panel 20 and the board 52. The inner edge 54 is abutted against the top plate 16. The board 52 and the wedge-shaped member 56 are secured to the top plate 16 and the side wall panel 20 using conventional means such as nails. The top surface 55 provides a deck for the lower border 38 of the roof 30.

As can be seen in FIG. 2, the relationship between the top plate 16 and the board 52 makes it very difficult to secure the board 52 and wedge-shaped member 56 to the top plate 16 and side wall panel 20. In point of fact, the board 52 is secured to the top plate 16 by toed nails 57, as seen in FIG. 2. The weight of the board 52, the insufficient support provided by wedge-shaped member 56, and the toenailed attachment make this structure unstable. It can also be appreciated that the side wall panel 20 must have a height that is equivalent to the overall height of the outer side walls of the building. Thus, in a building having outer side walls that are 4 feet high, the panels 20 must have a height of 4 feet. Further, a building having outer side walls that are 5 feet high requires side wall panels 20 having a height of 5 feet. Typically, the side wall panels 20 are cut from sheets of building material that are 4 feet wide and 8 feet long. Thus, in constructing a building having outer side walls that are 5 feet high, 3 feet of each sheet of building material using the conventional structure will be wasted. The excess 3 feet of building material cannot be used in a building which uses the conventional structure and has outer walls that are 4 feet high.

Figure 5:
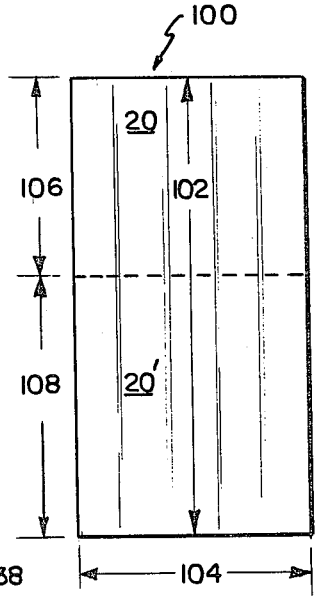
FIG. 5 is a plan view of a sheet of building material illustrating how waste is reduced by the building structure embodying the present invention.
Figure 4:
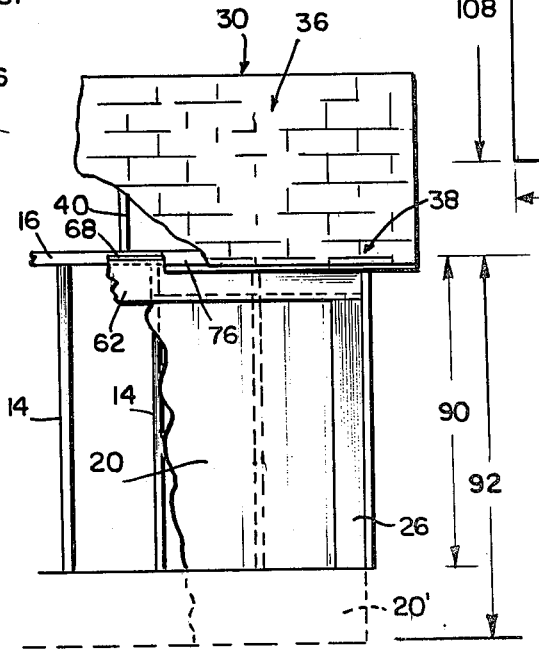
FIG. 4 is a fragmentary side elevational view, partly broken away, of the building structure shown in FIG. 1.
Figure 4:
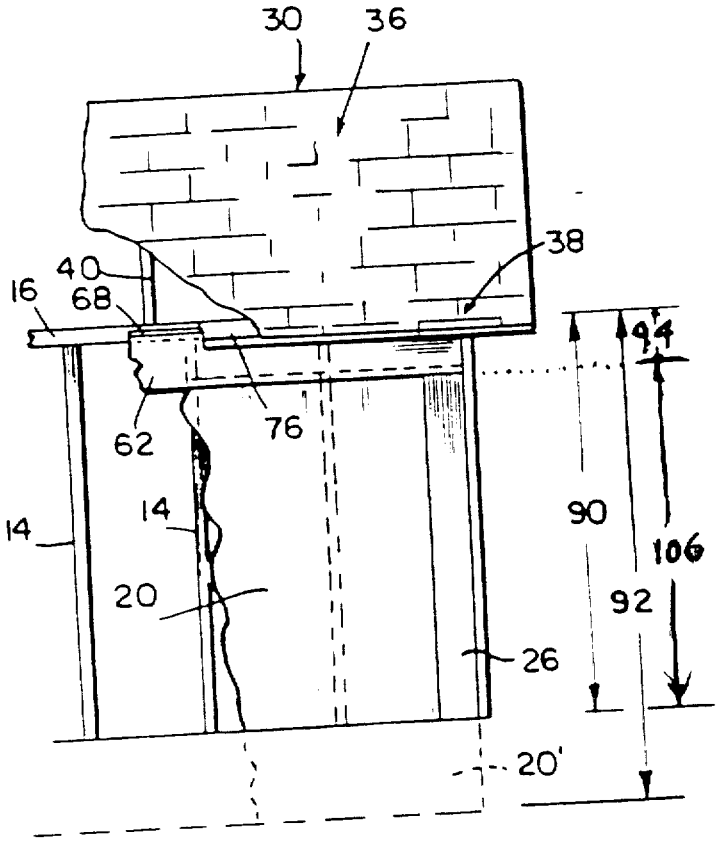

The improved structural means 60 embodying the present invention can best be described by referring to FIGS. 3, 4, and 5. The structural means 60 includes a frame member 62 which in the preferred embodiment is an elongated 2 inch by 6 inch wooden board. The frame member 62 extends horizontally beneath the lower border 38 of the roof 30 and has an inner surface 64 which engages the vertical studs 14 and the top plate 16. The frame member 62 is secured to the studs 14 and the top plate 16 by conventional means such as nails 65. The outer surface 66 of frame member 62 forms an upper portion of the outer side wall of the building structure 10. The top edge 68 of frame member 62 is cut so that the top edge 68 surface forms an acute angle 70 with respect to the inner surface 64 of the frame member 62. The top edge 68 is located in proximity to the lower border 38 of the roof 30, and provides a support surface for the lower roof border 38 in a manner which will be explained later. The acute angle 70 may vary, depending upon the desired slope of the overhanging lower border 38.

The bottom edge 72 of the frame member 62 includes a rabbet 74 for receiving the side panel 20. As shown in FIG. 3, the rabbet 74 is cut out of the bottom edge 72 and the inner surface 64 of the frame member 62. In the preferred embodiment, rabbet 74 has dimensions of ½ inch and ⅝ inch and extends longitudinally for receiving the top edge of a panel 20 having a thickness of ⅝ inch. It can be appreciated that the dimensions of the rabbet 74 may vary, depending upon the thickness of the panel 20. Panel 20 forms the lower portion of the outer side wall of the building structure 10. Thus, as best shown in FIG. 3, the outer side wall of a building structure 10 embodying the present invention is formed by frame member 62 and panel 20. Since in the preferred embodiment, frame member 62 is a 2 inch by 6 inch wooden board, the upper 6 inches of the side wall is provided by the frame member 62.

Referring particularly to FIG. 3, a roof deck or support member 76 for the lower roof border 38 is supported on the top edge 68 of the frame member 62. In the preferred embodiment, the deck member 76 is an elongated 1 inch by 3 inch wooden board. The board 76 has an inner edge 78 which is longitudinally cut so that the inner edge 78 surface forms an acute angle 80 with the top surface 82 of the roof member 76. This angle 80 in combination with angle 70 provides the slope for the lower border 38. Angle 80 is preferably equal to the acute angle 70. The bottom surface 84 of the roof member 76 engages the top edge 68 surface of the frame member 62 and is secured to the frame member 62 and top plate 16 of the frame 12 by conventional means such as nails. An acute angle 85 is formed between the outer surface 66 of a frame member 62 and the bottom surface 84 of roof member 76. Acute angle 85 is preferably equal to angles 70 and 80. In the prior art shown in FIG. 2, it was necessary to utilize a 2 inch by 6 inch board for the lower border 38 roof member 52 in order to provide a sufficient inner edge 54 for securing the member 52 to the top plate 16. The structural means 60 embodying the present invention allows the use of a smaller, lighter-weight board for the roof overhang support member 76 and provides a more stable lower roof border 38. As best shown in FIG. 3, nails 87 can be driven through the roof member 76 directly into the top edge 68 of the frame member 62, as opposed to being driven at a slant through the roof member 52 (toenailed) into the top plate 16, as shown in FIG. 2.

The elongated wedge-shaped piece cut from the top edge 68 of the frame member 62 may be secured to the outer surface 66 of the frame member 62 beneath the overhang of the roof member 76 as a decorative finishing piece. The wedge-shaped piece 86 may be secured to the outer surface 66 using conventional means such as nails.

Continuing to refer to FIG. 3, the frame member 62, in addition to forming an upper portion of the side wall of the building structure 10, also increases the strength, straightness, and stiffness of the frame 12. The frame member 62 is secured to the studs 14 transverse to their vertical orientation relative to each other. By further securing the frame member 62 to the top plate 16, wobbling of the studs 14 is reduced. The studs 14 remain straight and stiff, thereby increasing the overall strength of the frame structure 12. In a building structure 10 of the type shown in FIG. 1, the frame member 62 also provides frame structure between the studs 14 which can be used for mounting hooks, screws, or other hanging structures inside the building 10.

The structural means 60 also provides another advantage heretofore not provided by prior art structure. If a side panel 20 should be ruined or begin deteriorating, it can easily be replaced by pulling the panel 20 downward and out of the rabbet 74. Since rabbet 74 holds the upper edge of panel 20 in position, the panel 20 can be secured to the frame 12 using less nails than heretofore required. In order to remove a panel 20, it is only necessary to force the bottom edge of the panel 20 outward so that the nails no longer hold the panel 20 to the studs 14 and pull the panel 20 out of the rabbet 74.

Referring particularly to FIGS. 4 and 5, building structures 10 embodying the present invention with side walls having a height 90 of 4 feet and a height 92 of 5 feet can be constructed so that side panels 20 and 20' can be cut from a sheet of building material with no waste. Thus, the structural means 60 provides maximum utilization of side panel 20 building materials. Since frame member 62 forms an upper 6 inch portion of the side wall, a 3½ foot panel 20 is needed to form the lower portion, of a side wall having a height 90 of 4 feet, and a 4½ foot panel 20 is needed to form the lower portion of a side wall having a height 92 of 5 feet. Referring to FIG. 5, a sheet of building material 100 cut to form the panels 20 and 20' typically has a length 102 of 8 feet and a width 104 of 4 feet. Thus, a panel 20 having a height 106 of 3½ feet and a panel 20' having a height 108 of 4½ feet can be cut from the sheet 100 of building material, leaving no waste. Using the prior art structure, as shown in FIG. 2, it would be necessary to cut a panel 20 from sheet 100 having a height of 5 feet to produce a building having a side wall of 5 feet. This would leave a portion of the sheet of material 100 having a height of 3 feet. This remaining portion of the sheet 100 could not be used because a sheet having a height of 4 feet would be needed for a building with side walls having a height of 4 feet.

Utilizing the structural means 60 embodying the present invention, a building structure 10 can be produced at a lower cost while at the same time increasing its strength and decorative features, and while further making it easier to replace side panels 20. These advantages are achieved by reducing building material waste, increasing the rigidity and strength of the framework, and eliminating the need to nail or otherwise secure the upper portion of the side panels 20 to the framework. It will also appreciated that other advantages are also produced by the structural means 60 embodying the present invention, such as design flexibility and an additional inside frame structure between studs for hanging equipment inside the building structure 10.

What is claimed is:

1. A building structure, comprising outer walls, a foof including a low border that overhangs at least one of the outer walls, a frame for supporting the outer walls and roof, the frame including a plurality of spaced-apart studs and a frame member forming an upper portion of the one outer wall, the frame member having a top edge adjacent the roof and a bottom edge, means for securing the frame member to the studs to provide strength and rigidity of the frame, a wall panel secured to the studs adjacent the bottom edge of the frame member, the wall panel forming a lower portion of the one outer wall, and a roof support member on the top edge of the frame member to provide support for the lower border of the roof.

2. The building structure of claim 1, further comprising a rabbet in the bottom edge of the frame member for receiving a top edge of the wall panel.

3. The building structure of claim 2 wherein the tope edge of the frame member is at an acute angle with respect to an inner surface of the frame member so that the roof member slopes downwardly with respect to the one outer wall when supported on the top edge.

4. The building structure of claim 3 wherein the roof member includes an inner edge at an acute angle with respect to a top surface of the roof member, the acute angles of the frame and roof members being generally equal.

5. The building structure of claim 1 wherein the frame further includes at least one top plate secured to the top of the studs, and means for securing the frame member to the top plate to further provide strength and rigidity of the frame.

6. The building structure of claim 1 wherein the one outer wall has a predetermined height, the frame member has an outer surface having a predetermined width, and the wall panel has a height generally equal to the predetermined height of the one outer wall less the predetermined width of the outer surface of the frame member.

7. A building structure, comprising a frame including a plurality of spaced-apart studs, side walls, each side wall having an outer surface, a roof supported on the frame, the roof including a low border that overhangs at least one of the side walls, the outer surface of the one side wall including a wall panel and a section of the frame between the panel and the roof, the frame section having a top edge adjacent the roof and a bottom edge adjacent the panel, a rabbet formed in the bottom edge of the frame section for receiving the panel, a roof support member on the top edge of the frame section to provide support for the lower border of the roof, and means for connecting the frame section to the studs to provide strength and rigidity of the frame.

8. The building structure of claim 1 wherein the one side wall has an outer surface having a predetermined height, the frame section has a predetermined width, and the wall panel has a height determined by the difference between the predetermined height of the one side wall and the predetermined width of the outer surface of the frame section.

9. In a building structure of the type including outer walls, a roof having a lower border that overhangs at least one of the outer walls, a plurality of spaced-apart vertical studs supporting the walls and the roof, the improvement comprising a frame member, the frame member having a top edge adjacent the roof, a bottom edge, and an outer surface forming an upper portion of the one outer wall, means for securing the frame member transverse to the studs to provide strength and rigidity of the frame, a rabbet provided in the bottom edge of the frame member, a wall panel secured to the studs and having a top edge received in the rabbet of the frame member, the wall panel forming a lower portion of the one outer wall, a roof support member on the top edge of the frame member at an acute angle with respect to the outer surface of the frame member and overhanging the outer surface to provide support for the lower border of the roof.

* * * * *

UNITED STATES PATENT AND TRADEMARK OFFICE

CERTIFICATE OF CORRECTION

PATENT NO. : 4,481,744

DATED : November 13, 1984

INVENTOR(S) : Owen H. Park

It is certified that error appears in the above-identified patent and that said Letters Patent is hereby corrected as shown below:

Column 3, line 67, after "inches", insert --94--.

Column 3, line 68, after "62", insert --, as best shown in Fig. 4--.

Column 5, line 1, after "Since", insert --the width 94 of--.

Column 5, line 30, after "also", insert --be--.

Column 5, line 36 (claim 1), change "foof" to --roof--.

Column 5, line 53 (claim 3), change "tope" to --top--.

Column 5, line 56 (claim 3), after "roof", insert --support--.

Column 6, line 1 (claim 4), after "roof", insert --support--.

Column 6, line 3 (claim 4), after "roof", insert --support--.

Column 6, line 4 (claim 4), after "roof", insert --support--.

Column 6, line 12 (claim 6), after "has", insert --an outer surface having--.

Column 6, line 15 (claim 6), before "one", insert --outer surface of the--.

UNITED STATES PATENT AND TRADEMARK OFFICE

CERTIFICATE OF CORRECTION

PATENT NO. : 4,481,744

DATED : November 13, 1984

INVENTOR(S) : Owen H. Park

It is certified that error appears in the above-identified patent and that said Letters Patent is hereby corrected as shown below:

Column 6, line 34 (claim 8), after "has", insert --an outer surface having--.

Column 6, line 36 (claim 8), before "one", insert --outer surface of the--.

Fig. 4 should be deleted to be replaced with Fig. 4 as shown on the attached sheet.

Signed and Sealed this

*Twenty-first* Day of *January 1986*

[SEAL]

*Attest:*

DONALD J. QUIGG

*Attesting Officer*

*Commissioner of Patents and Trademarks*

Patent No. 4,481,744 November 13, 1984

Owen H. Park